US011536052B2

(12) United States Patent
Lai

(10) Patent No.: US 11,536,052 B2
(45) Date of Patent: Dec. 27, 2022

(54) ELECTRONIC STORAGE CABINET LOCK

(71) Applicant: XIAMEN MAKE SECURITY TECHNOLOGY CO., LTD., Fujian (CN)

(72) Inventor: Hongliang Lai, Xiamen (CN)

(73) Assignee: XIAMEN MAKE SECURITY TECHNOLOGY CO., LTD., Fujian (CN)

( * ) Notice: Subject to any disclaimer, the term of this patent is extended or adjusted under 35 U.S.C. 154(b) by 288 days.

(21) Appl. No.: 16/957,384

(22) PCT Filed: Feb. 12, 2018

(86) PCT No.: PCT/CN2018/076413
§ 371 (c)(1),
(2) Date: Jun. 24, 2020

(87) PCT Pub. No.: WO2019/153323
PCT Pub. Date: Aug. 15, 2019

(65) Prior Publication Data
US 2020/0332563 A1 Oct. 22, 2020

(51) Int. Cl.
*E05B 49/00* (2006.01)
*E05B 65/52* (2006.01)

(52) U.S. Cl.
CPC ..... *E05B 49/004* (2013.01); *E05B 65/52* (2013.01)

(58) Field of Classification Search
None
See application file for complete search history.

(56) References Cited

U.S. PATENT DOCUMENTS 9,536,359 B1 * 1/2017 Gokcebay ..... G07C 9/00182
10,465,422 B2 * 11/2019 Ullrich ..... E05B 47/0603

* cited by examiner

*Primary Examiner* — K. Wong
(74) *Attorney, Agent, or Firm* — Leong C. Lei

(57) ABSTRACT

An electronic storage cabinet lock includes a lock housing, a lock core, a circuit board, a motor assembly, a clutch mechanism and a battery assembly that are installed in an outer shell. A button assembly and a handle are mounted on the outer side of the outer shell. A cam is mounted on the motor assembly. One end of the lock core is secured in a shaft hole of the handle. When a password is correctly inputted, the button assembly transmits information to the circuit board to control the motor assembly to operate. The cam is driven to rotate to control the open state or closed state of the clutch mechanism. The handle can rotate to drive the lock core to rotate, thereby rotating a lock tongue to open the lock.

9 Claims, 11 Drawing Sheets

ELECTRONIC STORAGE CABINET LOCK

BACKGROUND OF THE INVENTION

1. Field of the Invention

The present invention relates to a novel electronic storage cabinet lock.

2. Description of the Prior Art

With the improvement of economic level, electronic intelligent lockers are widely used in homes, hotels, enterprises, public places and other places.

The clutch structure of a conventional electronic lock generally uses an electromagnet structure. This structure has low security and is easy to be damaged by magnets and other magnetic objects.

Most of conventional electronic locks are not equipped with emergency keys. When the electronic lock fails or the battery has run down, the locker door can only be opened by prying the lock or destroying the lock.

Most of the conventional electronic locks are not designed for waterproof, or the waterproof capacity is not good. When cleaning the locker or the lock body, water easily flows into the lock body, causing the electronic function of the lock body to fail.

Electronic locks that use a motor as a clutch drive on the market generally have a complex structure. Due to structural problems, the motor consumes high power, has poor stability, and has a short service life.

Most of the conventional electronic locks adopt a separate design. This design needs to separate the power supply part and the control part. It is inconvenient for installation. The two parts need to be installed separately, and a large installation space is required.

SUMMARY OF THE INVENTION

The primary object of the present invention is to provide a novel electronic storage cabinet lock to solve the problems of the conventional electronic locks, such as insufficient safety, no emergency key, no waterproof, high power consumption of the motor, and inconvenient installation.

In order to achieve the above object, the present invention adopts the following technical solutions:

An electronic storage cabinet lock comprises a lock housing, a lock core, a circuit board, a motor assembly, a clutch mechanism and a battery assembly that are installed in an outer shell. A button assembly is mounted on an outer side of the outer shell. The button assembly, the motor assembly and the battery assembly are electrically connected to the circuit board. When a password is correctly inputted, the button assembly transmits information to the circuit board, and the circuit board controls the motor assembly to operate. A cam is mounted on an output shaft of the motor assembly. A handle is mounted on the outer side of the outer shell. The lock core is installed in the lock housing. One end of the lock core, having a lock hole, is secured in a shaft hole of the handle. The lock hole is exposed on an outer side of the handle. A lock tongue mounted on the lock core is exposed on an inner side of the outer shell. The clutch mechanism is located between the cam and the handle. The clutch mechanism is a mechanical clutch. When the motor assembly drives the cam to rotate, the clutch mechanism is controlled by the cam to be in a disengaged state or an engaged state. The handle can be rotated to drive the lock core to rotate, so that the lock tongue is rotated to unlock the lock.

The clutch mechanism includes a hasp, an operating lever, and a clasp. The hasp and the operating lever are installed in the outer shell in a lever manner. The clasp is rotatably installed in the outer shell. An operating lever spring is installed between the operating lever and the outer shell. A clasp spring is installed between the clasp and the outer shell. One end of the hasp cooperates with the cam. Another end of the hasp cooperates with one end of the operating lever. Another end of the operating lever cooperates with an inner side of the clasp. An outer side of the clasp is formed with an engaging block to cooperate with an engaging groove formed on an inner side of the handle. When the motor assembly drives the cam to rotate until the cam presses the hasp, the hasp is tilted, and the tilted hasp further presses the operating lever so that the operating lever is also tilted. The tilted operating lever releases the clasp so that the clasp can rotate, the clutch mechanism is in the disengaged state, and the handle can be rotated to unlock the lock.

One end of the hasp is formed with an arc-shaped surface to cooperate with the cam, and the other end of the hasp is formed with a press head to cooperate with one end of the operating lever. A middle portion of the hasp is supported on a fulcrum in the outer shell.

The other end of the operating lever is formed with a protrusion to cooperate with a groove of the clasp for positioning the clasp.

The engaging block of the clasp and the engaging groove of the handle each have an arc shape to cooperate with each other.

A first sealing ring is provided between a back of the handle and the outer shell.

A second sealing ring is provided between the lock core and the outer shell.

One end of the lock core, having the lock hole, is provided with a dust cover and a washer.

A sealing pad is provided on the inner side of the outer shell.

After the above structure is adopted, in use, after a correct password is inputted, the battery assembly supplies power to the motor assembly. The rotation of the motor drives the cam to rotate. The rotation of the cam makes the clutch mechanism in a disengaged state. At this time, the handle can be rotated to drive the lock tongue to rotate, thereby achieving unlocking. When the handle drives the lock tongue to return to the initial position, the motor rotates to drive the cam to rotate. The clutch mechanism is in the engaged state and returns to the initial position to hold the handle, so that the handle cannot be rotated, so as to achieve the locking function.

The structure of the present invention realizes an integrated design and simplifies the installation of the lock. The function of the emergency key is designed, which provides an emergency unlocking function when the electronic function fails, without damaging the lock or cabinet body. The motor-driven clutch mechanism design not only has high stability but also has safety performance. The design of the novel clutch mechanism also makes the structure more stable.

The present invention further comprises a first sealing ring between the back of the handle and the outer shell to prevent water seeping in through the joint of the handle and the outer shell. One end of the lock core, having the lock hole, is provided with a dust cover and a washer to prevent water or mist from entering the lock core. A second sealing ring is provided between the lock core and the outer shell to prevent water seeping in through the joint of the handle and the outer shell.

DETAILED DESCRIPTION OF THE PREFERRED EMBODIMENTS

Figure 1:
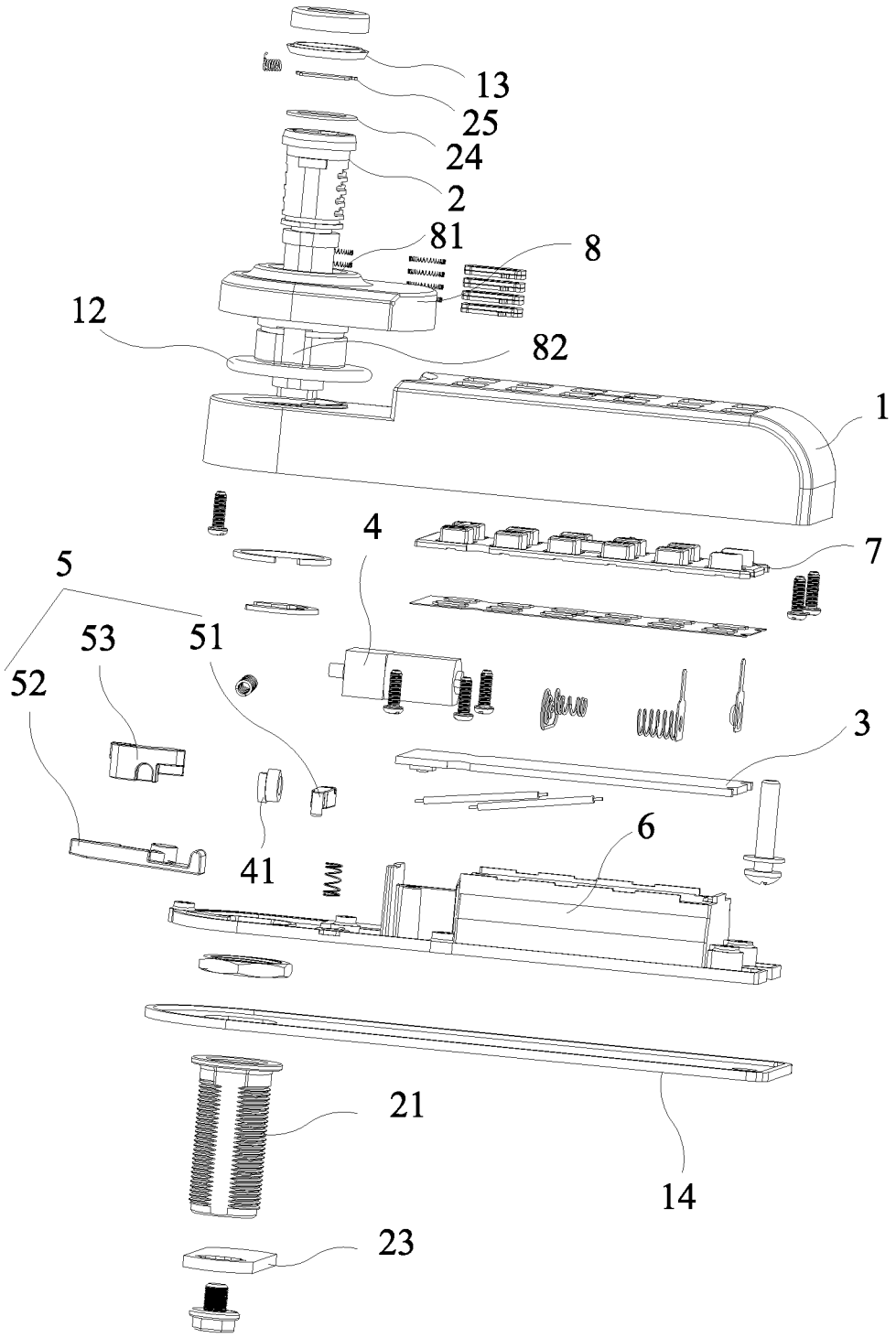
FIG. 1 is an exploded view of the present invention.
Figure 2:
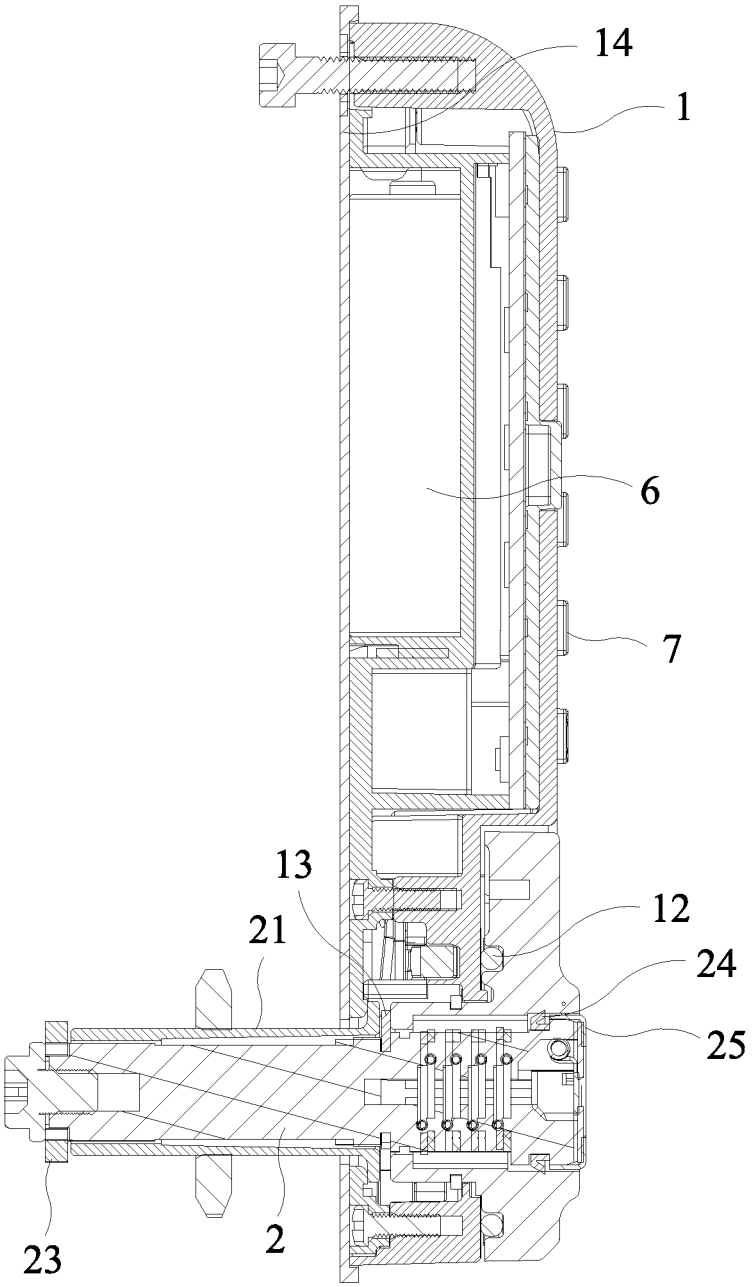
FIG. 2 is an assembled sectional view of the present invention.
Figure 3:
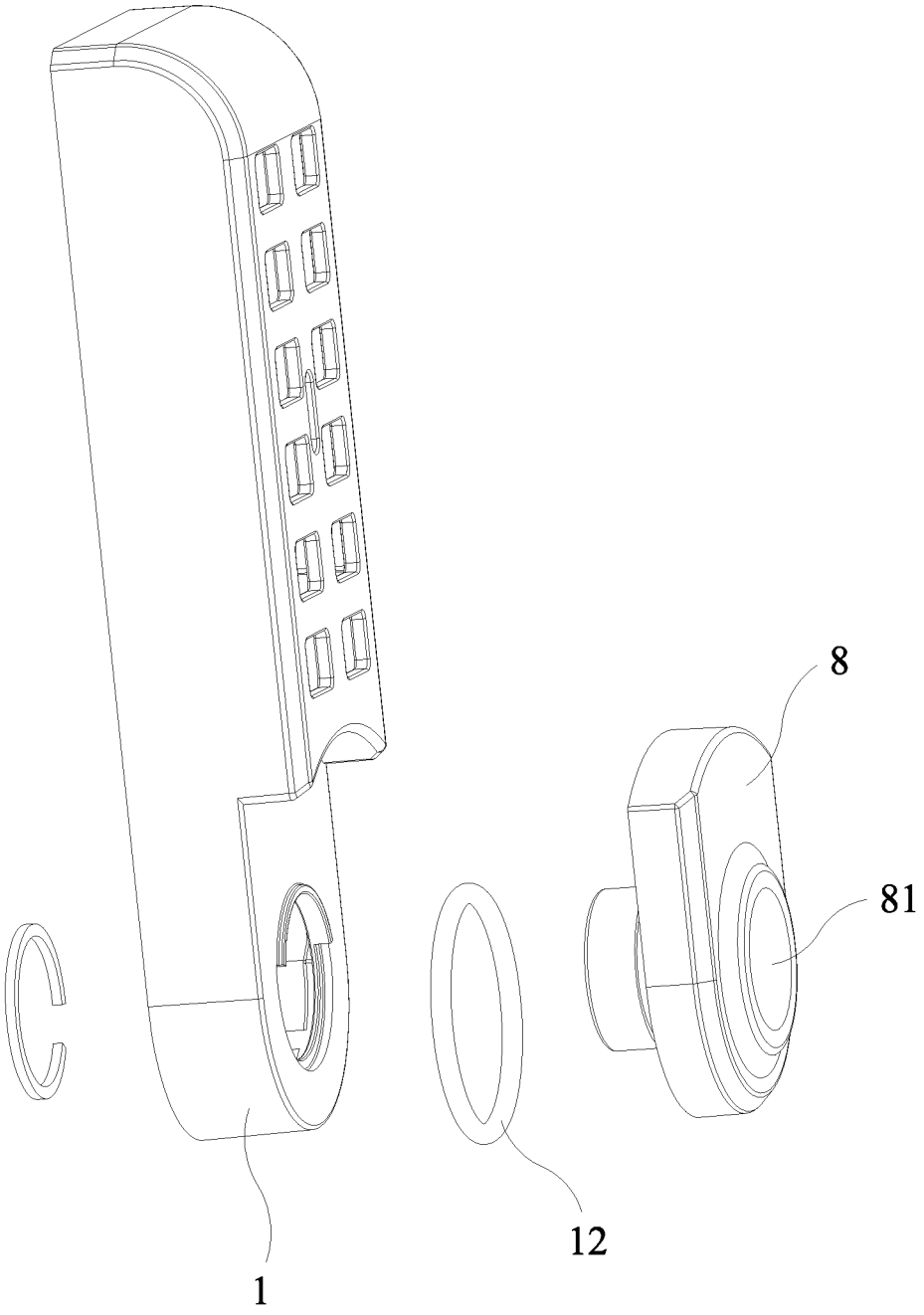
FIG. 3 is a schematic view of the handle and the outer shell.
Figure 4:
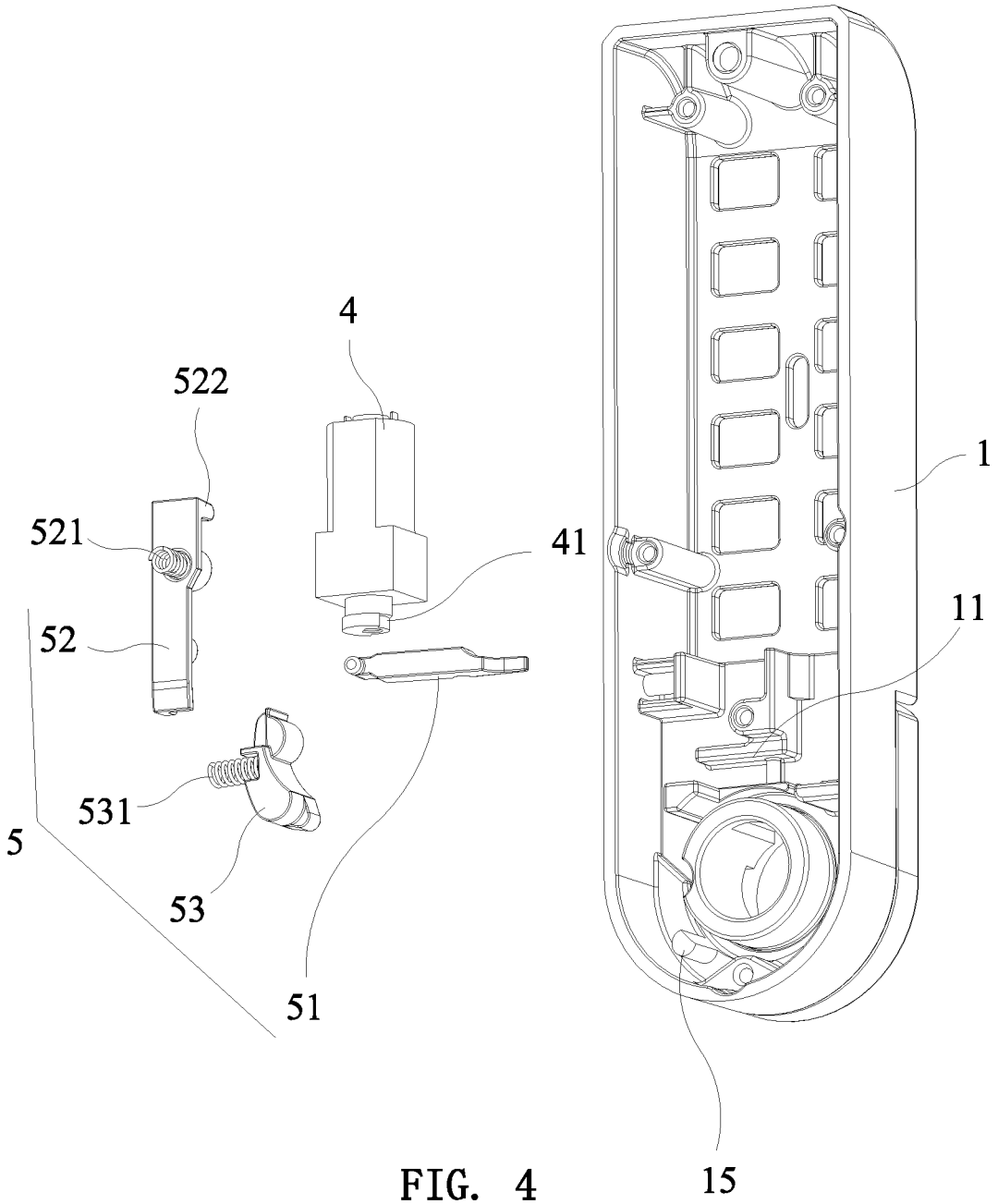
FIG. 4 is an exploded view of the clutch mechanism and the outer shell.
Figure 5:
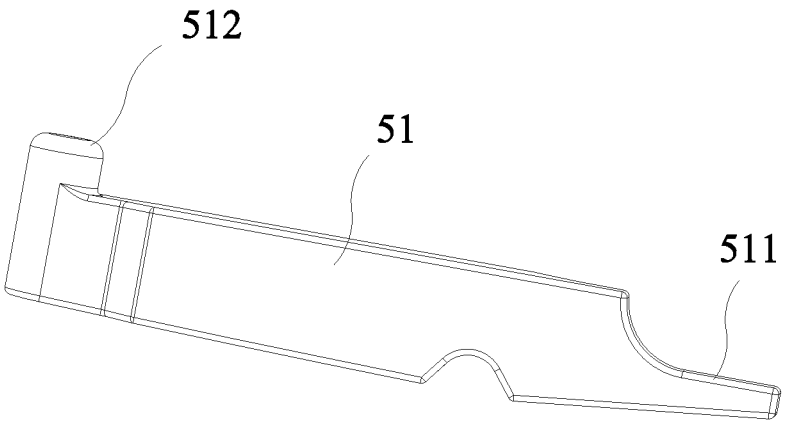
FIG. 5 is a schematic view of the hasp.
Figure 6:
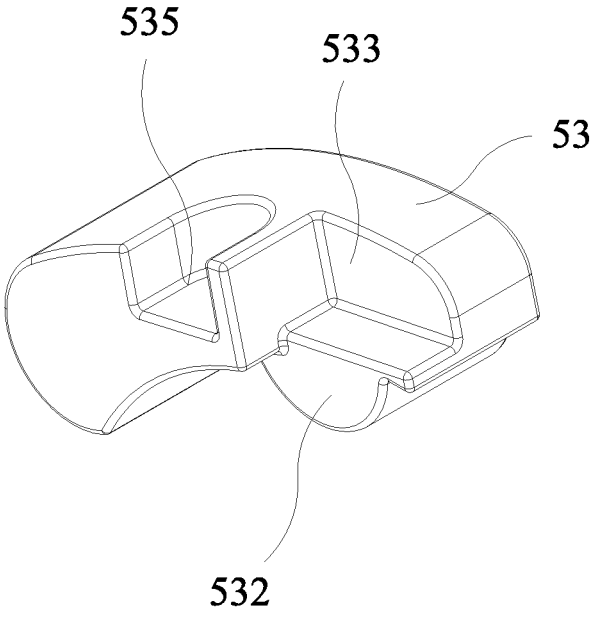
FIG. 6 is a schematic view showing the inner side of the clasp.
Figure 7:
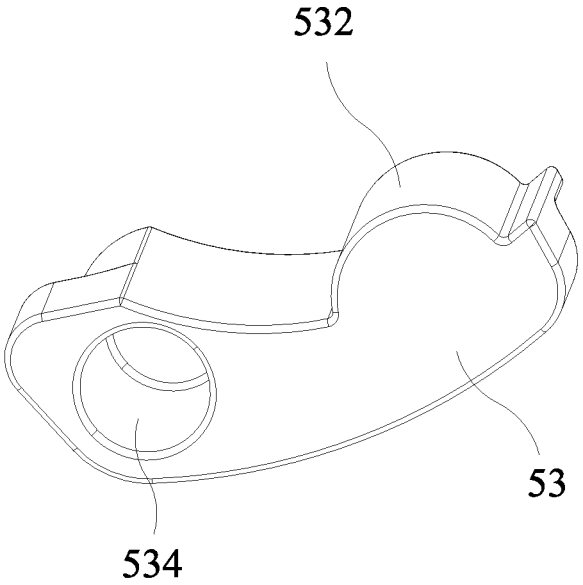
FIG. 7 is a schematic view showing the outer side of the clasp.
Figure 8:
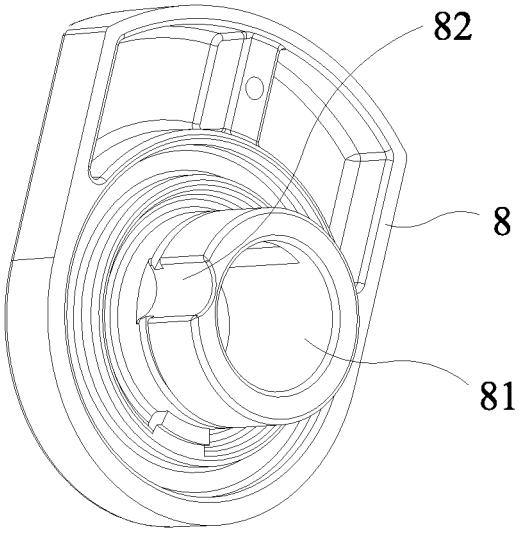
FIG. 8 is a schematic view showing the inner side of the handle.
Figure 9:
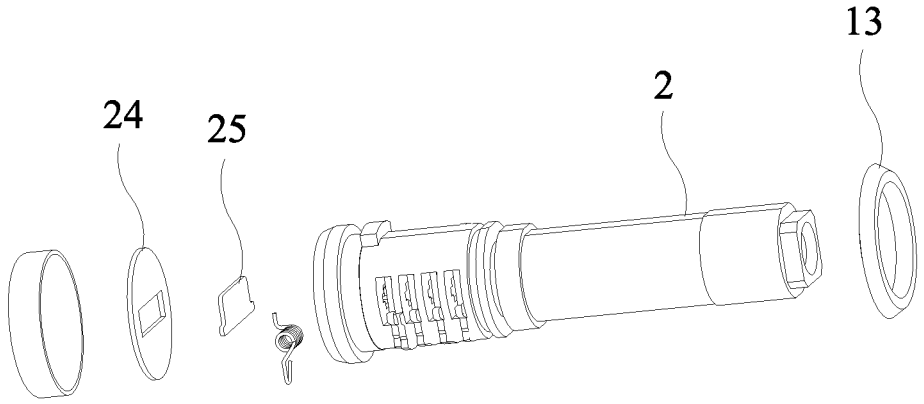
FIG. 9 is a schematic view of the lock core.
Figure 10:
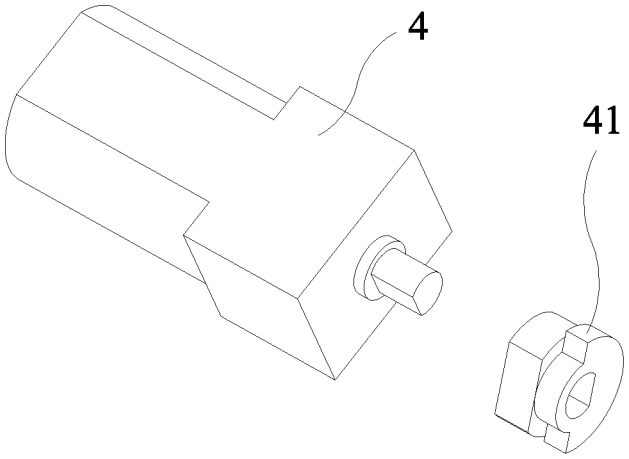
FIG. 10 is an exploded view of the motor assembly.
Figure 11:
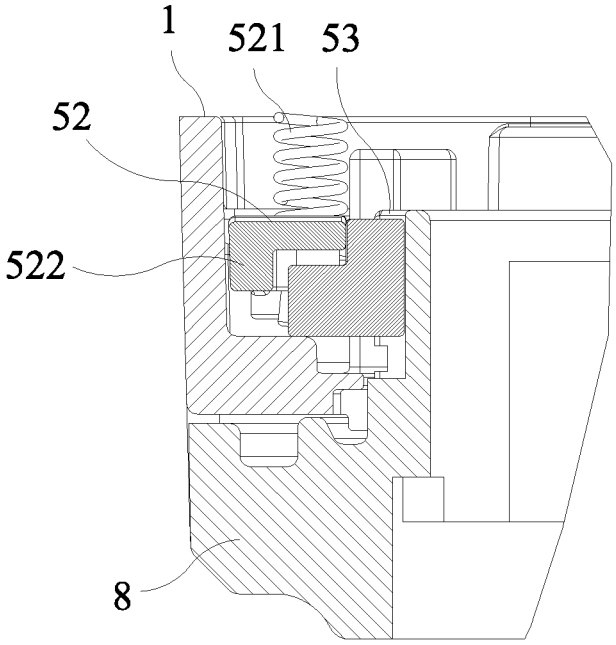
FIG. 11 is a schematic view showing the clutch mechanism in an engaged state.
Figure 12:
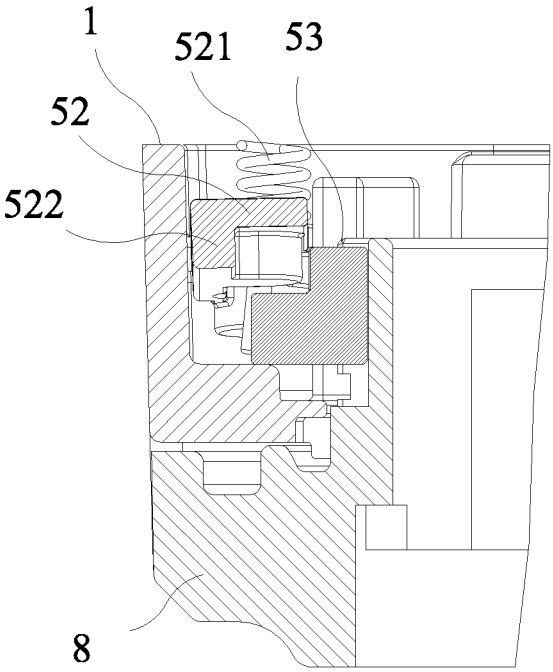
FIG. 12 is a schematic view showing the clutch mechanism in a disengaged state.
Figure 13:
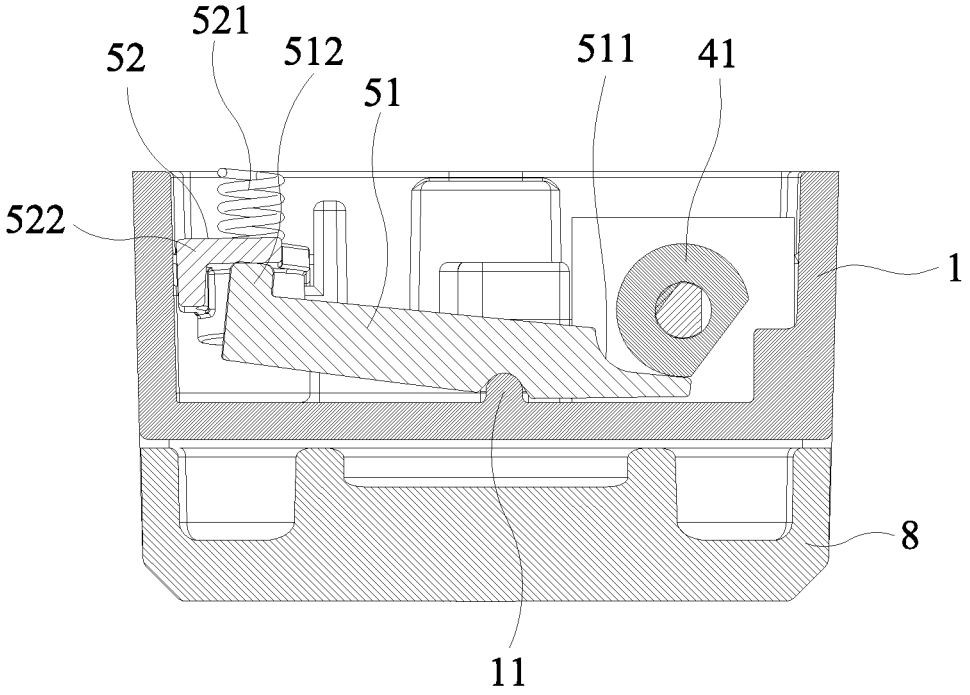
FIG. 13 is a schematic view showing the operation of the clutch mechanism.
Figure 14:
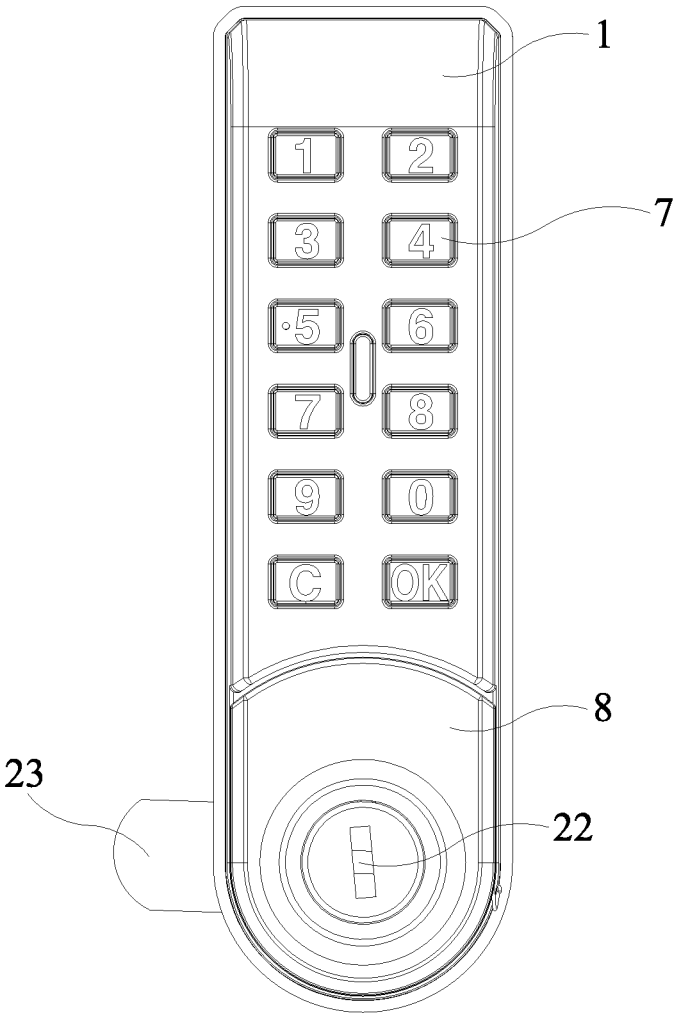
FIG. 14 is a schematic view of the present invention in a locked state.
Figure 15:
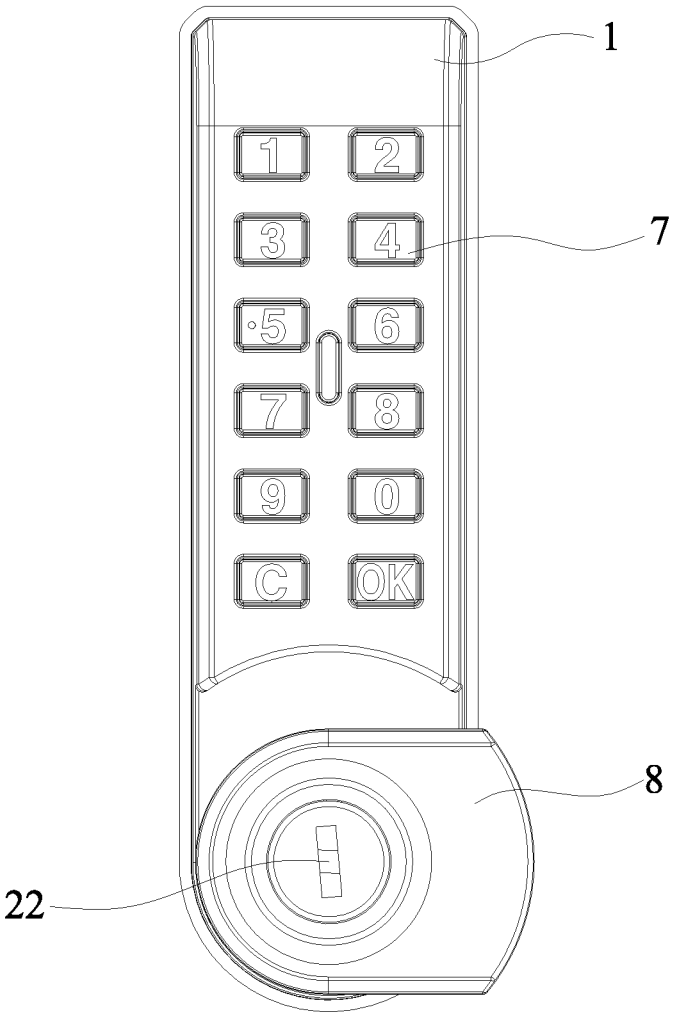
FIG. 15 is a schematic view of the present invention in an unlocked state.

As shown in FIGS. 1 to 8, the present invention discloses a novel electronic storage cabinet lock, comprising a lock housing 21, a lock core 2, a circuit board 3, a motor assembly 4, a clutch mechanism 5 and a battery assembly 6 that are installed in an outer shell 1. A button assembly 7 is mounted on an outer side of the outer shell 1. The button assembly 7, the motor assembly 4 and the battery assembly 6 are electrically connected to the circuit board 3. The battery assembly 6 supplies power to the motor assembly 4 and the circuit board 3. When a password is correctly inputted, the button assembly 7 transmits information to the circuit board 3, and the circuit board 3 controls the motor assembly 4 to operate. A cam 41 is mounted on an output shaft of the motor assembly 4. A handle 8 is mounted on the outer side of the outer shell 1. The lock core 2 is installed in the lock housing 21. One end of the lock core 2, having a lock hole 22, is secured in a shaft hole 81 of the handle 8. The lock core 2 can be driven by the handle 8 to rotate for unlocking the lock. The lock hole 22 is exposed on the outer side of the handle 8 for unlocking the lock with an emergency key. A lock tongue 23 mounted on the lock core 2 is exposed on an inner side of the outer shell 1. The clutch mechanism 5 is located between the cam 41 and the handle 8. The clutch mechanism 5 is a mechanical clutch. When a password is correctly inputted, the motor assembly 4 drives the cam 41 to rotate. The clutch mechanism 5 is controlled by the cam 41 to be in a disengaged state. The handle 8 can be rotated to drive the lock core 2 to rotate, and the lock tongue 23 can be rotated to unlock the lock. When the handle 8 drives the lock tongue 23 to return to the initial position, the motor assembly 4 drives the cam 41 to rotate, and the clutch mechanism 5 is in an engaged state and returns to the initial position to hold the handle 8. The handle 8 cannot be rotated, thereby realizing the locking function.

The structure of the present invention realizes an integrated design and simplifies the installation of the lock. The function of the emergency key is designed, which provides an emergency unlocking function when the electronic function fails, without damaging the lock or cabinet body. The motor-driven clutch mechanism design not only has high stability but also has safety performance.

The clutch mechanism 5 of the present invention specifically includes a hasp 51, an operating lever 52, and a clasp 53. Both the hasp 51 and the operating lever 52 are installed in the outer shell 1 in a lever manner. The clasp 53 is rotatably installed in the outer shell 1 through a shaft 15 and a hole 534. An operating lever spring 521 is installed between the operating lever 52 and the outer shell 1 for returning the operating lever 52. A clasp spring 531 is installed between the clasp 53 and the outer shell 1 for returning the clasp 53. The clasp 53 has a spring groove 535 for installation of the clasp spring 531. One end of the hasp 51 cooperates with the cam 41, and the other end of the hasp 51 cooperates with one end of the operating lever 52. Preferably, one end of the hasp 51 is formed with an arc-shaped surface 511 to cooperate with the cam 41, and the other end of the hasp 51 is formed with a press head 512 to cooperate with one end of the operating lever 52. The middle portion of the hasp 51 is supported on a fulcrum 11 in the outer shell 1. The other end of the operating lever 52 cooperates with the inner side of the clasp 53. The outer side of the clasp 53 is formed with an engaging block 532 to cooperate with an engaging groove 82 formed on the inner side of the handle 8. Preferably, the other end of the operating lever 52 is formed with a protrusion 522 to cooperate with a groove 533 of the clasp 53 for positioning the clasp 53. The engaging block 532 of the clasp 53 and the engaging groove 82 of the handle 8 each have an arc shape to cooperate with each other. When the motor assembly 4 drives the cam 41 to rotate until the cam 41 presses the hasp 51, the hasp 51 is tilted, and the tilted hasp 51 further presses the operating lever 52 so that the operating lever 52 is also tilted. The tilted operating lever 52 releases the clasp 53 so that the clasp 53 can rotate. At this time, the clutch mechanism 5 is in a disengaged state, and the handle 8 can be rotated to unlock the lock. The design of the novel clutch mechanism of the present invention makes the structure more stable.

The present invention further comprises a first sealing ring 12 between the back of the handle 8 and the outer shell 1 to prevent water seeping in through the joint of the handle 8 and the outer shell 1. A second sealing ring 13 is provided between the lock core 2 and the outer shell 1 to prevent water seeping in through the joint of the handle 8 and the outer shell 1. One end of the lock core 2, having the lock hole 22, is provided with a dust cover 25 and a washer 24 to prevent water or mist from entering the lock core 2. A sealing pad 14 is provided on the inner side of the outer shell 1 to prevent water or mist from entering the outer shell 1.

What is claimed is:

1. An electronic storage cabinet lock, comprising a lock housing, a lock core, a circuit board, a motor assembly, a clutch mechanism and a battery assembly that are installed in an outer shell; a button assembly being mounted on an outer side of the outer shell, the button assembly, the motor assembly and the battery assembly being electrically connected to the circuit board, wherein when a password is correctly inputted, the button assembly transmits information to the circuit board and the circuit board controls the motor assembly to operate, a cam being mounted on an output shaft of the motor assembly; a handle being mounted on the outer side of the outer shell, the lock core being installed in the lock housing, one end of the lock core, having a lock hole, being secured in a shaft hole of the handle, wherein the lock hole is formed in the one end of the lock core and exposed on an outer side of the handle, a lock tongue mounted on the lock core being exposed on an inner side of the outer shell; the clutch mechanism being located between the cam and the handle, the clutch mechanism being a mechanical clutch, wherein when the motor assembly drives the cam to rotate, the clutch mechanism is controlled by the cam to be in a disengaged state or an engaged state, the handle can be rotated to drive the lock core to rotate, so that the lock tongue is rotated to unlock the lock.

2. The electronic storage cabinet lock as claimed in claim 1, wherein the clutch mechanism includes a hasp, an operating lever and a clasp, the hasp and the operating lever are installed in the outer shell in a lever manner, the clasp is rotatably installed in the outer shell, an operating lever spring is installed between the operating lever and the outer shell, a clasp spring is installed between the clasp and the outer shell, one end of the hasp cooperates with the cam, another end of the hasp cooperates with one end of the operating lever, another end of the operating lever cooperates with an inner side of the clasp, an outer side of the clasp is formed with an engaging block to cooperate with an engaging groove formed on an inner side of the handle, when the motor assembly drives the cam to rotate until the cam presses the hasp, the hasp is tilted, and the tilted hasp further presses the operating lever so that the operating lever is also tilted, the tilted operating lever releases the clasp so that the clasp can rotate, the clutch mechanism is in the disengaged state, and the handle can be rotated to unlock the lock.

3. The electronic storage cabinet lock as claimed in claim 2, wherein one end of the hasp is formed with an arc-shaped surface to cooperate with the cam, the other end of the hasp is formed with a press head to cooperate with one end of the operating lever, and a middle portion of the hasp is supported on a fulcrum in the outer shell.

4. The electronic storage cabinet lock as claimed in claim 2, wherein the other end of the operating lever is formed with a protrusion to cooperate with a groove of the clasp for positioning the clasp.

5. The electronic storage cabinet lock as claimed in claim 2, wherein the engaging block of the clasp and the engaging groove of the handle each have an arc shape to cooperate with each other.

6. The electronic storage cabinet lock as claimed in claim 1, wherein a first sealing ring is provided between a back of the handle and the outer shell.

7. The electronic storage cabinet lock as claimed in claim 1, wherein a second sealing ring is provided between the lock core and the outer shell.

8. The electronic storage cabinet lock as claimed in claim 1, wherein one end of the lock core, having the lock hole, is provided with a dust cover and a washer.

9. The electronic storage cabinet lock as claimed in claim 1, wherein a sealing pad is provided on the inner side of the outer shell.

* * * * *